US007168097B2

(12) United States Patent
Grilliot et al.

(10) Patent No.: US 7,168,097 B2
(45) **Date of Patent: *Jan. 30, 2007**

(54) PROTECTIVE GARMENT HAVING REVERSIBLE SHELL FOR MILITARY OR PARAMILITARY FIREFIGHTER OR EMERGENCY WORKER

(75) Inventors: William L. Grilliot, Dayton, OH (US); Mary I. Grilliot, Dayton, OH (US); Patricia K. Lewis, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 99 days.

This patent is subject to a terminal disclaimer.

(21) Appl. No.: 11/079,793

(22) Filed: Mar. 14, 2005

(65) Prior Publication Data

US 2005/0155130 A1 Jul. 21, 2005

Related U.S. Application Data

(63) Continuation-in-part of application No. 10/780,162, filed on Feb. 17, 2004, now Pat. No. 6,892,394, which is a continuation of application No. 10/350,871, filed on Jan. 24, 2003, now Pat. No. 6,728,970.

(51) Int. Cl.
*A41D 13/00* (2006.01)

(52) U.S. Cl. ..... 2/81; 2/97

(58) Field of Classification Search ..... 2/81, 2/93, 94, 96, 97, 69, 85, 115, 915, 77, 102, 2/DIG. 2

See application file for complete search history.

(56) References Cited

U.S. PATENT DOCUMENTS

| | | | | | |
|---|---|---|---|---|---|
| 238,945 | A | * | 3/1881 | Marks | 2/93 |
| 1,052,475 | A | * | 2/1913 | Friedman | 2/93 |
| 1,224,704 | A | * | 5/1917 | Berger | 2/85 |
| 1,648,250 | A | * | 11/1927 | Woislawsky | 2/98 |
| 1,914,236 | A | * | 6/1933 | Berkwits | 2/253 |
| 1,971,682 | A | * | 8/1934 | Hoch | 2/85 |
| 2,138,041 | A | * | 11/1938 | Harlan | 2/93 |
| 2,174,831 | A | * | 10/1939 | Muller | 112/424 |
| 2,711,539 | A | * | 6/1955 | Loscher | 2/93 |
| 3,018,486 | A | * | 1/1962 | Bukspan | 2/87 |

(Continued)

FOREIGN PATENT DOCUMENTS

DE 82 03 991.7 7/1982

*Primary Examiner*—Tejash Patel
(74) *Attorney, Agent, or Firm*—Wood, Phillips, Katz, Clark & Mortimer

(57) ABSTRACT

For a military or paramilitary firefighter or emergency worker, a protective garment has an outer shell, an inner liner providing thermal insulation, and a moisture barrier between the outer shell and the inner liner. The outer shell has a surface of high visibility and a surface of low visibility and is reversible. The outer shell has reflective trim on the surface of high visibility but not on the surface of low visibility. The inner liner and the moisture barrier are attachable detachably to the outer shell so as to be wearable within whichever surface becomes an inner surface of the outer shell. The protective garment with the surface of high visibility facing outwardly and with the inner liner and the moisture barrier worn within the outer shell conforms to the National Fire Protection Association (NFPA) 1971 standard for "Protective Clothing for Structural Fire Fighting."

10 Claims, 1 Drawing Sheet

U.S. PATENT DOCUMENTS 4,103,361 A * 8/1978 Carmen ..... 2/97
4,338,686 A * 7/1982 Bell ..... 2/93
4,472,835 A * 9/1984 Clark ..... 2/102
4,774,725 A * 10/1988 Page ..... 2/81
5,029,344 A * 7/1991 Shannon et al. ..... 2/69
5,040,243 A * 8/1991 Tatsuno ..... 2/108
5,043,202 A * 8/1991 Knickerbocker ..... 428/195.1
5,054,125 A * 10/1991 Snedeker ..... 2/81
5,159,718 A * 11/1992 Moyer ..... 2/69
5,189,737 A * 3/1993 Ribicic ..... 2/93
5,542,124 A * 8/1996 Grilliot et al. ..... 2/81
5,884,332 A * 3/1999 Snedeker ..... 2/97
5,933,865 A * 8/1999 Aldridge ..... 2/81
6,089,194 A * 7/2000 LaBelle ..... 119/850
6,345,393 B1 * 2/2002 Bayer ..... 2/94
6,421,834 B2 * 7/2002 Kester ..... 2/94
6,550,066 B1 * 4/2003 Brassey ..... 2/93
6,728,970 B1 * 5/2004 Grilliot et al. ..... 2/81
6,892,394 B2 * 5/2005 Grilliot et al. ..... 2/81

* cited by examiner

PROTECTIVE GARMENT HAVING REVERSIBLE SHELL FOR MILITARY OR PARAMILITARY FIREFIGHTER OR EMERGENCY WORKER

CROSS-REFERENCES TO RELATED APPLICATIONS

This application is a continuation-in-part of U.S. patent application Ser. No. 10/780,162, which was filed on Feb. 17, 2004 now U.S. Pat. No. 6,892,394, which was published as United States Patent Application Publication No. U.S. 2004/0181843 A1, and the disclosure of which is incorporated herein by reference. U.S. patent application Ser. No. 10/780,162 is a continuation of U.S. patent application Ser. No. 10/350,871, which was filed on Jan. 24, 2003, from which U.S. Pat. No. 6,728,970 B1 issued on May 4, 2004, and the disclosure of which is incorporated herein by reference.

TECHNICAL FIELD OF THE INVENTION

This invention pertains to a protective garment for a firefighter or emergency worker, particularly a military or paramilitary firefighter or emergency worker. This invention contemplates that an outer shell of the protective garment is reversible so as to expose, as an outer surface, either an expansive surface of high visibility or an expansive surface of low visibility.

BACKGROUND OF THE INVENTION

Protective garments for firefighters and emergency workers include coats, trousers, overalls, and coveralls. Current National Fire Protection Association (NFPA) standards include the National Fire Protection Association (NFPA) 1971 standard for "Protective Clothing for Structural Fire Fighting", hereinafter NFPA 1971. NFPA 1971 requires protective clothing to have an outer shell meeting certain standards for heat resistance, flame, resistance, and tear strength. NFPA 1971 requires all layers of protective clothing to meet certain standards for thermal protection performance. NFPA 1971 requires the outer shell of said clothing to have reflective trim, which enhances the visibility of the protective garment and, therefore, the visibility of its wearer under smoke-laden and other adverse conditions. Generally, reflective trim is affixed by sewing, adhesively, or otherwise.

However, for a military or paramilitary firefighter or emergency worker operating where a tactical operation has developed or is expected to develop, a need for low visibility may override a need for high visibility. Heretofore, a military or paramilitary firefighter or emergency worker may have to be issued two types of protective garments, i.e., protective garments to be worn in a tactical operation, in which the need for low visibility overrides the need for high visibility, and protective garments to be worn otherwise.

The discussion of NFPA 1971 in the Background of the Invention in U.S. Pat. No. 5,933,865 is incorporated herein by reference.

SUMMARY OF THE INVENTION

This invention provides for a military or paramilitary firefighter or emergency worker, a protective garment having an outer shell, an inner liner providing thermal insulation, and a moisture barrier between the outer shell and the inner liner. The outer shell, which has two expansive surfaces comprised of a surface of high visibility and a surface of low visibility, is reversible so that, when the protective garment is worn, one said surface becomes an outer surface of the outer shell and the other surface becomes an inner surface of the outer shell. The outer shell has portions that are reflective, fluorescent, or both on the surface of high visibility but not on the surface of low visibility. The inner liner and the moisture barrier are attachable detachably to the outer shell so as to be wearable within whichever of the expansive surfaces becomes the inner surface of the outer shell.

This invention contemplates that the protective garment with the surface of high visibility facing outwardly and with the inner liner and the moisture barrier worn within the outer shell conforms to the National Fire Protection Association (NFPA) 1971 standard for "Protective Clothing for Structural Fire Fighting."

Preferably, the portions that are reflective, fluorescent, or both are provided by trim affixed to the outer shell, on the surface of high visibility. Desirably, when facing outwardly, the surface of low visibility appears dark in ambient light, appears black in ambient light, or displays camouflage.

DETAILED DESCRIPTION OF THE ILLUSTRATED EMBODIMENT

Figure 1:
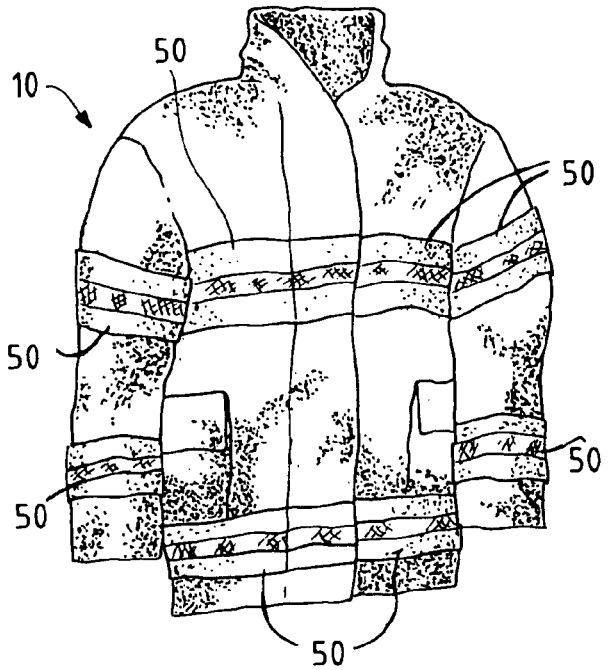
FIG. 1 is a front elevation of a protective coat embodying this invention and having an outer shell, which is reversible, as worn with an outer surface of the outer shell being of high visibility because of reflective trim.

As illustrated, a protective coat 10 for a military or paramilitary firefighter or emergency worker embodies this invention and has an outer shell 20 and an lining system 30. The outer shell 20 has two expansive surfaces, which are comprised of a surface 40 of high visibility because of reflective trim 50 affixed by sewing, adhesively, or otherwise to the outer shell, on the surface 40, and a surface 60 of low visibility. The outer shell 20 is reversible so that, when the protective coat 10 is worn, one said surface 40, 60, becomes an outer surface of the outer shell and the other surface 40, 60, becomes an inner surface of the outer shell 20.

Figure 2:
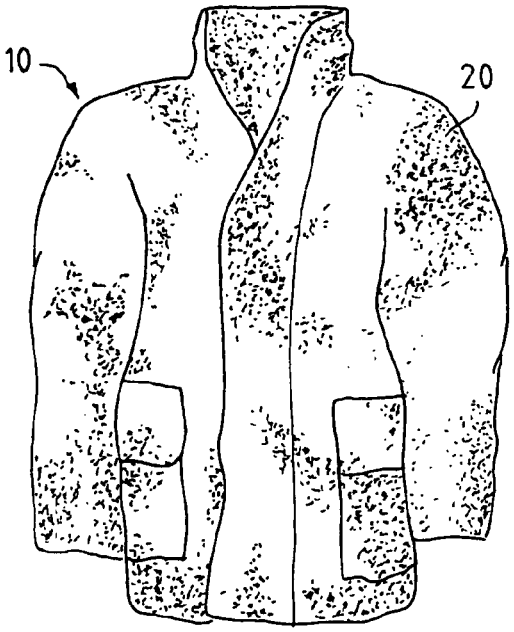
FIG. 2 is a front elevation of the same coat, as worn with the outer surface of the outer shell being of low visibility.
Figure 3:
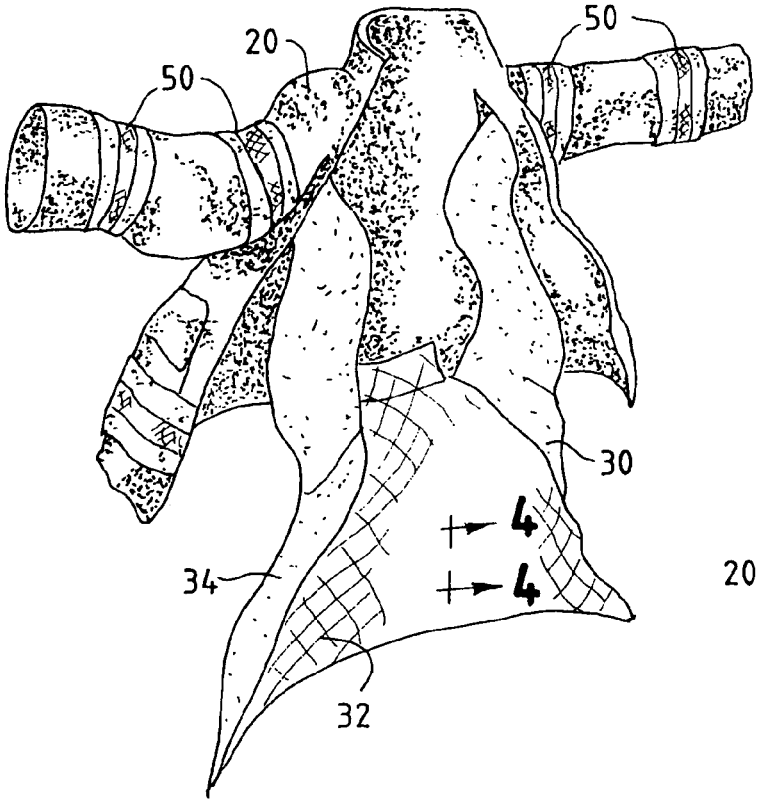
FIG. 3 is a similar view of the same coat, as illustrated in FIG. 1, except that the coat is open so as to illustrate that an inner liner of the coat is detachable.
Figure 5:
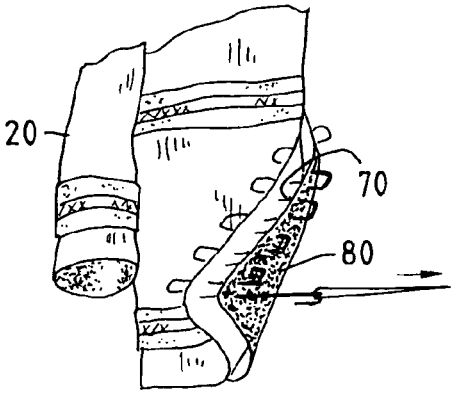
FIG. 5 is a fragmentary detail illustrating that, in an alternative embodiment, the outer shell has two layers affixed to each other, as by sewing, one said layer providing a surface of high visibility because of reflective trim and the other layer providing a surface of low visibility.

Preferably, as illustrated in FIGS. 1, 2, and 3, the outer shell 20 is made from a single layer of material, which appears black, or at least dark, in ambient light, except where reflective trim 50 is provided, or which displays camouflage, except where reflective trim 50 is provided. Alternatively, as illustrated in FIG. 5, the outer shell 20 is made from two layers of material, which are affixed to each other by sewing, as illustrated, adhesively, or otherwise and which are comprised of a layer 70 having reflective trim 50 and providing the surface 40 of high visibility and a layer 80 appearing black, or at least dark, in ambient light or displaying camouflage and, moreover, providing the surface 60 of low visibility.

Preferably, whether made from a single layer of material or from two layers of material, the outer shell 20 conforms to all applicable standards of the National Fire Protection Association (NFPA) standard 1971 for "Protective Clothing for Structural Fire Fighting. A preferred material for the outer shell 20, when made from a single layer, is Nomex™ material having a basis weight of nine ounces (9 oz.) per square yard, as available commercially from E.I. du Pont de Nemours and Company of Wilmington, Del. Such material is available commercially in patterns that display camouflage. Such material having a combined basis weight of nine ounces (9 oz.) per square yard in two layers is useful for the outer shell 20, when made from two layers. Scotchlite" reflective trim is suitable, as available commercially from Minnesota Mining and Manufacturing Company of St. Paul, Minn.

Figure 4:
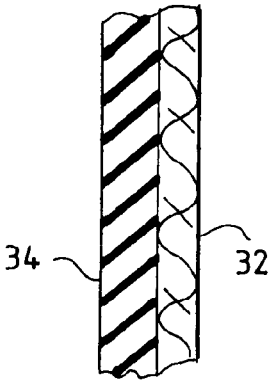
FIG. 4, on a larger scale, is a fragmentary cross-section taken along line 4—4 of FIG. 3, in a direction indicated by arrows.

As illustrated in FIG. 4, the lining system 30 comprised an intermediate liner 32 defining a moisture barrier and an inner liner 34 providing thermal insulation. Additionally, the lining system 30 may comprise another layer or other layers between the outer shell 20 and the inner liner 34. The lining system 30 is attachable detachably to the outer shell 20, via snaps, buttons, zippers, hook-and-loop fasteners, or other known means, so as to be wearable within whichever of the expansive surfaces 40, 60, becomes the inner surface of the outer shell 20. The protective coat 10 with the surface 40 of high visibility facing outwardly and with the lining system 30 worn within the outer shell 10 conforms to the National Fire Protection Association (NFPA) 1971 standard for "Protective Clothing for Structural Fire Fighting."

In a tactical operation, in which the need for low visibility overrides the need for high visibility, a military or paramilitary firefighter or emergency worker may wear the protective coat 10 with the surface 60 of low visibility facing outwardly. Otherwise, the firefighter or emergency worker may wear the protective coat 10 with the surface 40 of high visibility facing outwardly. If a tactical operation develops or is expected to develop while a military or paramilitary firefighter or emergency worker is wearing the protective garment 10 with the surface 40 of high visibility facing outwardly, the firefighter or emergency worker may have an opportunity to doff the protective coat 10, detach the inner liner 20, reverse the outer shell 20, re-attach the inner liner 20, and re-don the protective coat 10 with the surface 60 of low visibility facing outwardly.

Although a protective coat is illustrated, this invention may be also embodied in other protective garments, such as trousers, overalls, and coveralls.

The invention claimed is:

1. A protective garment for a military or paramilitary firefighter or emergency worker, wherein the protective garment has an outer shell, an inner liner providing thermal insulation, and a moisture barrier between the outer shell and the inner liner, wherein the outer shell has two expansive surfaces comprised of a surface of high visibility and a surface of low visibility, the outer shell being reversible so that, when the protective garment is worn, one said surface becomes an outer surface of the outer shell and the other surface becomes an inner surface of the outer shell, wherein the outer shell has portions that are reflective, fluorescent, or both on the surface of high visibility but not on the surface of low visibility, wherein the inner liner and the moisture barrier are attachable detachably to the outer shell so as to be wearable within whichever of the expansive surfaces becomes the inner surface of the outer shell, and wherein the outer shell complies with all applicable standards of the National Fire Protection Association (NFPA) 1971 standard for "Protective Clothing for Structural Fire Fighting."

2. The protective garment of claim 1, wherein the protective garment with the surface of high visibility facing outwardly and with the inner liner and the moisture barrier worn within the outer shell conforms to the National Fire Protection Association (NFPA) 1971 standard for "Protective Clothing for Structural Fire Fighting."

3. The protective garment of claim 1, wherein those portions are provided by trim affixed on the outer shell, on the surface of high visibility.

4. The protective garment of claim 1, wherein, when facing outwardly, the surface of low visibility appears dark in ambient light.

5. The protective garment of claim 1, wherein, when facing outwardly, the surface of low visibility appears black in ambient light.

6. The protective garment of claim 1, wherein, when facing outwardly, the surface of low visibility displays camouflage.

7. The protective garment of claim 2, wherein those portions are provided by trim affixed on the outer shell, on the surface of high visibility.

8. The protective garment of claim 2, wherein, when facing outwardly, the surface of low visibility appears dark in ambient light.

9. The protective garment of claim 2, wherein, when facing outwardly, the surface of low visibility appears black in ambient light.

10. The protective garment of claim 2, wherein, when facing outwardly, the surface of low visibility displays camouflage.

* * * * *